US007824243B2

(12) United States Patent
Hu et al.

(10) Patent No.: US 7,824,243 B2
(45) Date of Patent: Nov. 2, 2010

(54) CHEMICAL MECHANICAL PLANARIZATION METHODS

(75) Inventors: Tien-Chen Hu, Ping-Tung (TW); Jung-Sheng Hou, Tainan (TW); Chun-Chin Huang, Houbi Shiang (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 555 days.

(21) Appl. No.: 11/765,815

(22) Filed: Jun. 20, 2007

(65) Prior Publication Data

US 2008/0318494 A1 Dec. 25, 2008

(51) Int. Cl.
*B24B 49/00* (2006.01)
*B24B 51/00* (2006.01)

(52) U.S. Cl. ..... 451/5; 451/8; 451/36; 451/41; 451/53; 451/63

(58) Field of Classification Search ..... 451/36, 451/41, 63, 451, 53
See application file for complete search history.

(56) References Cited

U.S. PATENT DOCUMENTS

| | | | | |
|---|---|---|---|---|
| 6,053,801 | A * | 4/2000 | Pinson et al. | 451/56 |
| 6,251,001 | B1 * | 6/2001 | Pinson et al. | 451/449 |
| 6,997,782 | B2 * | 2/2006 | Nishi et al. | 451/41 |
| 7,234,999 | B2 * | 6/2007 | Sakurai et al. | 451/5 |
| 7,361,076 | B2 * | 4/2008 | Sakurai et al. | 451/5 |

* cited by examiner

*Primary Examiner*—Timothy V Eley
(74) *Attorney, Agent, or Firm*—Duane Morris LLP

(57) ABSTRACT

A semiconductor process includes polishing a substrate with a slurry in an enclosure. Polishing the substrate is stopped. First mist is injected into the enclosure, such that the first mist has at least about 80% of saturation of a liquid or gaseous solvent in a carrier within the enclosure.

12 Claims, 5 Drawing Sheets

CHEMICAL MECHANICAL PLANARIZATION METHODS

BACKGROUND OF THE INVENTION

1. Field of the Invention

The present invention relates to semiconductor methods and systems, and more particularly to chemical mechanical planarization (CMP) methods and systems.

2. Description of the Related Art

With advances in electronic products, semiconductor technology has been applied widely in manufacturing memories, central processing units (CPUs), liquid crystal displays (LCDs), light emitting diodes (LEDs), laser diodes and other devices or chip sets. In order to achieve high-integration and high-speed requirements, dimensions of semiconductor integrated circuits have been reduced and various materials, such as copper and ultra low-k dielectrics, have been proposed along with techniques for overcoming manufacturing obstacles associated with these materials and requirements. In order to form a copper damascene structure, various chemical mechanical planarization (CMP) processes, such as oxide CMP or metal CMP, have been proposed and used.

The CMP process uses abrasive and corrosive chemical slurry in conjunction with a polishing pad and a dynamic polishing head retaining a wafer. The dynamic polishing head is rotated with different axes of rotation to press the wafer against the polishing pad. The CMP process removes material and evens out irregular topography of the wafer so as to flatten or planarize the wafer. During the CMP process, chemicals in a slurry react with and/or weaken the material to be removed. The abrasives accelerate the weakening process and the polishing pad helps to wipe the reacted materials from the surface of the wafer.

Due to the high rotational speed of the polishing head, slurries may be spun away from the polishing pad and/or polishing head and attach on other parts of the CMP system. The spun slurries may become dried or solidified after attaching on these other parts of the CMP system. The solidified slurries may detach from the parts of the CMP system, falling on the polishing pad. During a polishing process, the detached solidified slurries may scratch the surface of the wafer and destroy the topography of the wafer. The detached solidified slurries may be a factor affecting a yield of integrated circuits formed on the wafer.

From the foregoing, it can be seen that CMP methods and apparatus are desired.

SUMMARY OF THE INVENTION

In accordance with some exemplary embodiments, a semiconductor process includes polishing a substrate with a slurry in an enclosure. Polishing the substrate is stopped. First mist is injected into the enclosure, such that the first mist has at least about 80% of saturation of a liquid or gaseous solvent in a carrier within the enclosure.

In accordance with other exemplary embodiments, an apparatus includes at least one fluid switch coupled to a chemical mechanical planarization (CMP) apparatus disposed in an enclosure. At least one first pressure valve is coupled to the fluid switch. At least one manifold is coupled to the pressure valve. At least one rinse nozzle is coupled to the first pressure valve, wherein a fluid flows through the fluid switch so as to trigger the first pressure valve, such that the manifold injects mist into the enclosure through the rinse, such that the mist has at least about 80% of saturation of a liquid or gaseous solvent in a carrier within the enclosure nozzle so as to substantially fill the enclosure with mist.

The above and other features will be better understood from the following detailed description of the exemplary embodiments of the invention that is provided in connection with the accompanying drawings.

BRIEF DESCRIPTION OF THE DRAWINGS

Following are brief descriptions of exemplary drawings. They are mere exemplary embodiments and the scope of the present invention should not be limited thereto.

DETAILED DESCRIPTION OF EXEMPLARY EMBODIMENTS

Figure 1A:
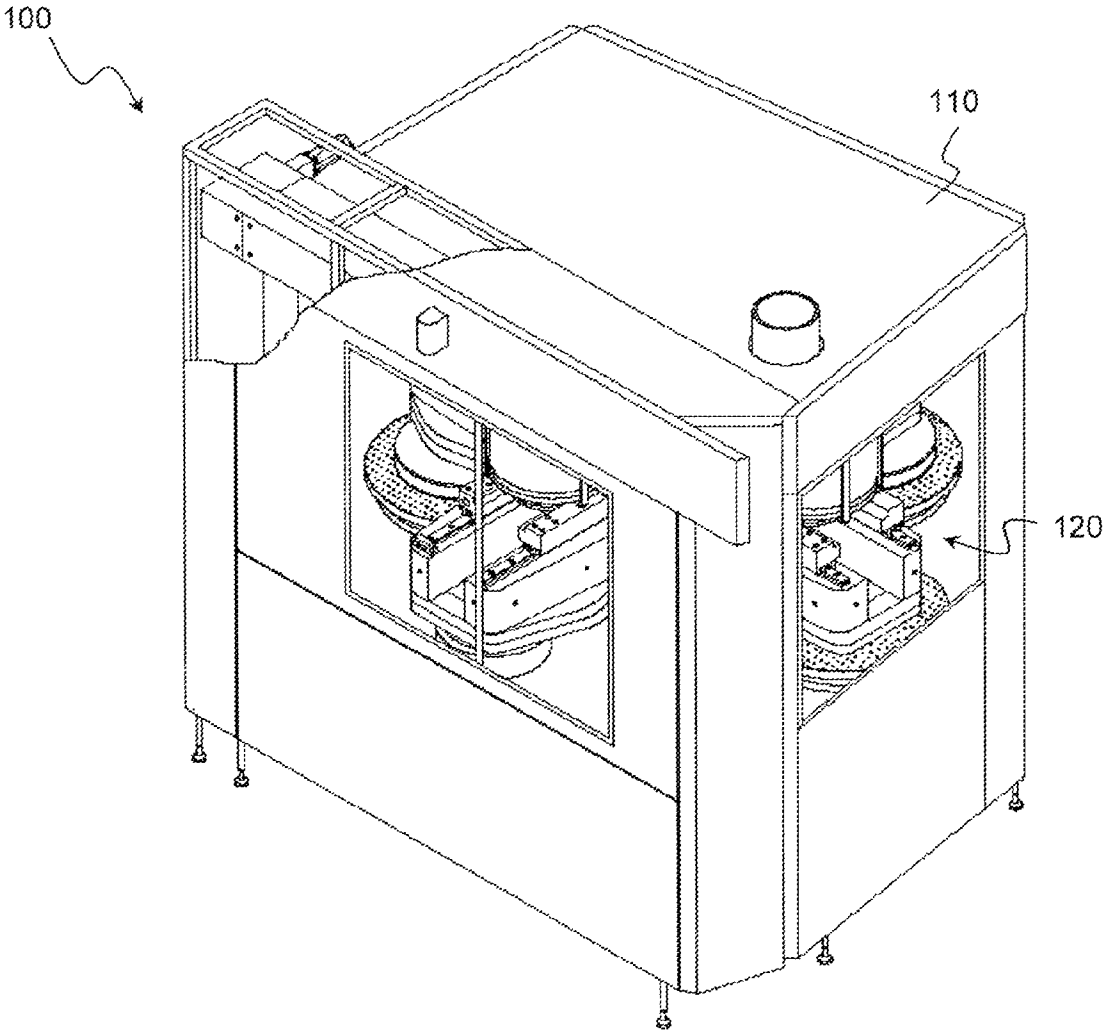
FIG. 1A is a schematic drawing showing a chemical mechanical planarization (CMP) apparatus disposed in an enclosure.

This description of the exemplary embodiments is intended to be read in connection with the accompanying drawings, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus/device be constructed or operated in a particular orientation.

FIG. 1A is a schematic drawing showing a chemical mechanical planarization (CMP) apparatus disposed in an enclosure. Referring to FIG. 1A, equipment 100 may include a semiconductor processing apparatus such as a CMP apparatus 120 disposed within an enclosure 110. In some embodiments, the enclosure 110 may include at least one window (not labeled) through which operators or engineers may see operation of the CMP apparatus 120. In some embodiments, the equipment 100 is a Mira Mesa CMP system available from Applied Materials Inc., Santa Clara, Calif., U.S.A.

Figure 1B:
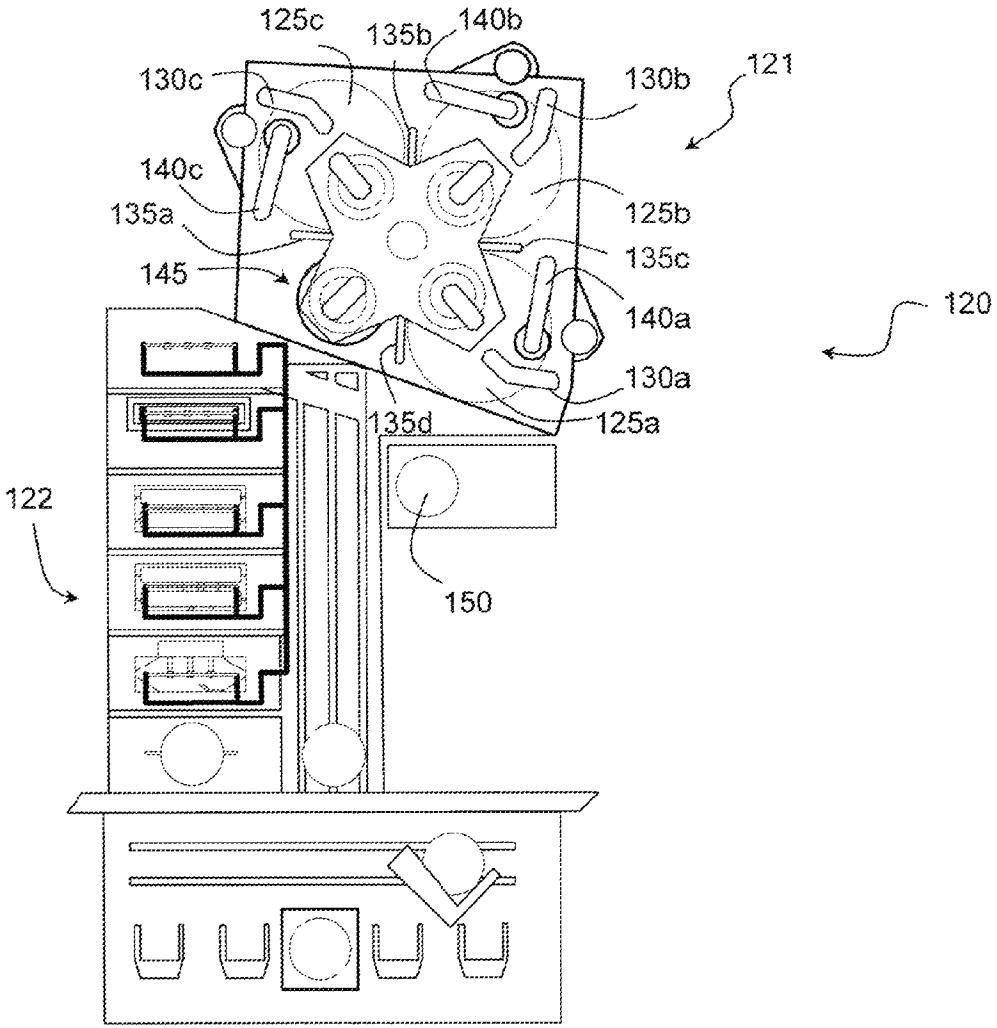
FIG. 1B is a top view of a CMP apparatus shown in FIG. 1A
Figure 1C:
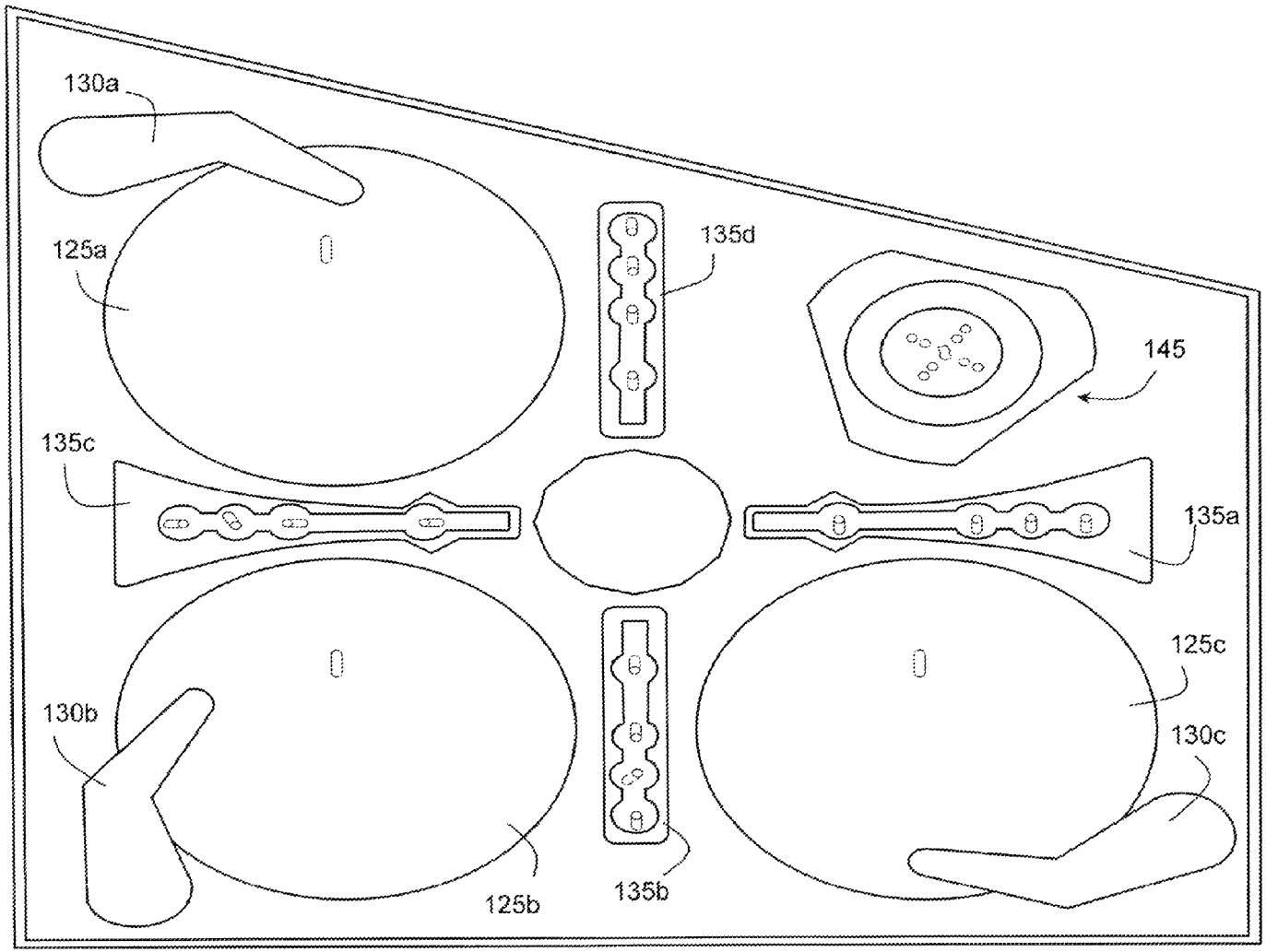
FIG. 1C is an enlarged view of a portion of a polishing area FIG. 1B.

FIG. 1B is a top view of the CMP apparatus 120 shown in FIG. 1A, and FIG. 1C is an enlarged view of a portion of the polishing area 121 shown in FIG. 1B. The CMP apparatus 120 may include a polishing area 121 and a cleaning area 122. The polishing area 121 may include at least one platen such as platens 125*a*-125*c*, at least one dispenser such as dispensers 130*a*-130*c*, at least one rinse nozzle such as inter-platen rinse nozzles 135*a*-135*d*, at least one pad conditioner such as pad conditioners 140*a*-140*c* and a load cup 145. Though the exemplary embodiment uses three platens, three dispensers, four rinse nozzles, three pad conditioners and one load cup, the scope of the invention is not limited thereto. Other numbers of the platens, dispensers, rinse nozzles, pad conditioners and load cup may be used in other embodiments.

In some embodiments, the load cup 145 may be configured to hold a substrate 150 for polishing. The substrate 150 may be a wafer substrate, display substrate, such as liquid crystal display (LCD), plasma display, cathode ray tube display or electro luminescence (EL) lamp, light emitting diode (LED)

substrate or reticle (collectively referred to as, substrate 150), for example. The platens 125*a*-125*c* may be configured to support the substrate 150 for polishing. The dispensers 130*a*-130*c* may be configured to provide a high pressure rinse to clean the platens 125*a*-125*c* during and/or after the polishing process. The pad conditioners 140*a*-140*c* may be configured to provide slurry on the platens 125*a*-125*c* for polishing.

In some embodiments, the inter-platen rinse nozzles 135*a*-135*d* may be configured to provide a mixture of air and de-ionized (DI) water for removing the remaining slurry or particles on the platens 125*a*-125*c* after the polishing process. In other embodiments, the inter-platen rinse nozzles 135*a*-135*d* may be configured to provide mist at an injection pressure between about 20 psi and about 40 psi, such that the mist may have at least about 80% of saturation of a liquid or gaseous solvent (e.g., deionized water) in a carrier (e.g., air) within the enclosure 110 may substantially fill the enclosure 110 (shown in FIG. 1A). In some embodiments, the mist may include water vapor and/or condensed water. In some embodiments, the mist within the enclosure 110 may have a temperature between about 20° C. and about 24° C.

In some embodiments, the mist can be generated by mixing a gas such as air and a liquid such as DI water. The DI water may have an injection pressure between about 25 psi and about 35 psi, and the air may have an injection pressure between about 60 psi and about 110 psi. In other embodiments, the DI water may have an injection pressure of about 30 psi, and the air may have an injection pressure of about 90 psi. With the mist present in the enclosure 110, remaining slurry attached to inside walls and windows of the enclosure 110 may desirably deliquesce and/or be removed away. Accordingly, scratches resulting from solidified slurries detached from the inside walls and windows of the enclosure 110 may desirably be prevented.

The cleaning area 122 may include at least one cleaner (not labeled). The cleaner may provide DI water, at least one of acid (e.g., phosphoric acid, perchloric acid, hydroidic acid, hydrobromic acid, hydrochloric acid, sulfuric acid, nitric acid, chloric acid, bromic acid, perbromic acid, iodic acid, periodic acid, fluorantimonic acid, magic acid, carborane sueracid, fluorosulfuric acid, triflic acid or other acid) and/or base (e.g., potassium hydroxide, barium hydroxide, cesium hydroxide, sodium hydroxide, strontium hydroxide, calcium hydroxide, lithium hydroxide, rubidium hydroxide, alanine, ammonia, methylamine, pyridine or other base). The cleaning area 122 is configured to clean the substrate 150 after the polishing process.

Figure 2:
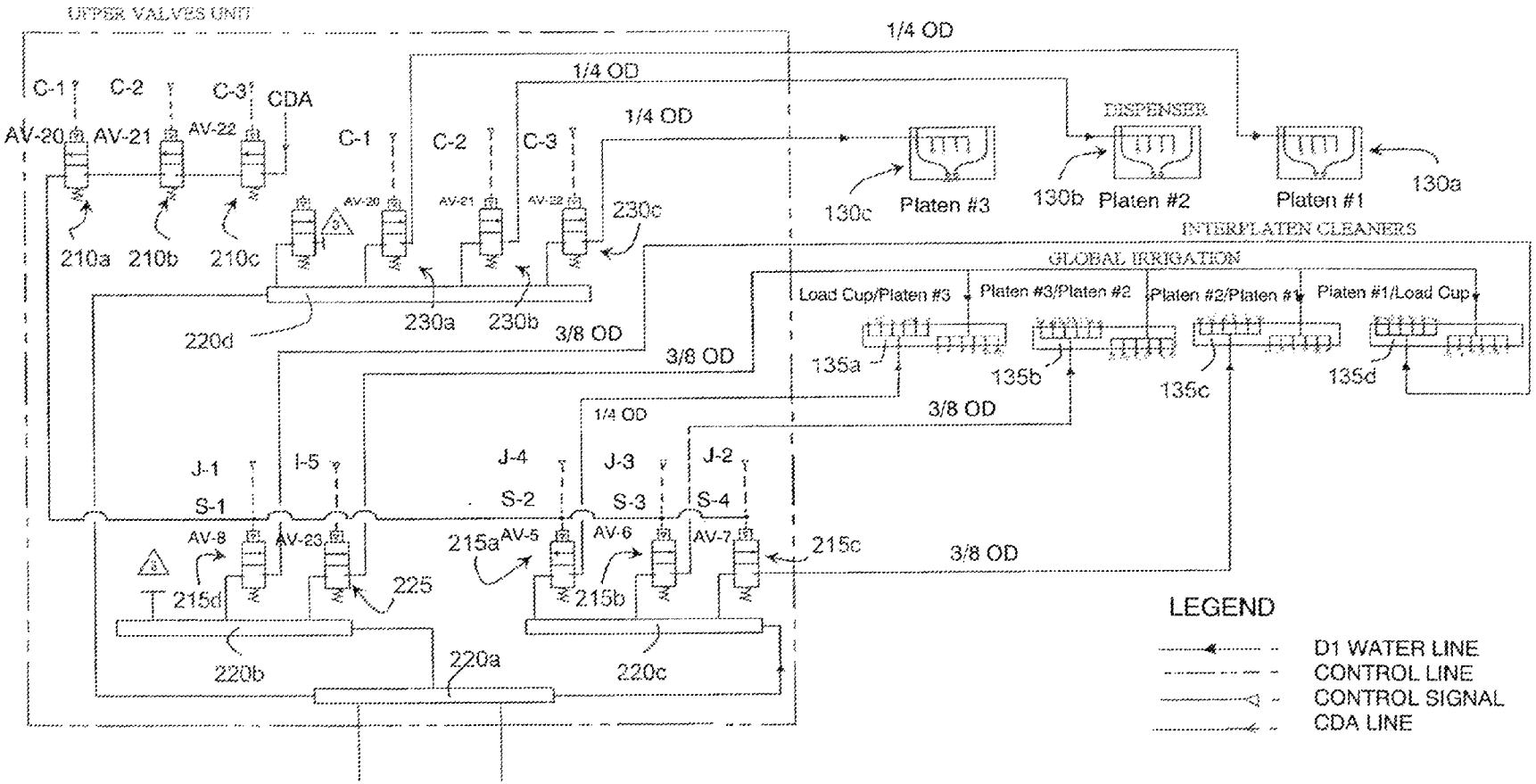
FIG. 2 is a schematic layout of an operational system of a CMP system.

FIG. 2 is a schematic layout of a control system of a CMP system. Referring to FIG. 2, at least one fluid switch such as air switches 210*a*-210*c* are coupled to the CMP apparatus 120 (shown in FIG. 1A). In some embodiments, the air switches 210*a*-210*c* may be coupled to a processor (not shown) configured to control the operation of the CMP apparatus 120.

In some embodiments, the air switches 210*a*-210*c* may be coupled in series. The series air switches 210*a*-210*c* may be coupled to at least one pressure valve such as pressure valves 215*a*-215*d*. At least one manifold such as manifold 220*a* coupled to at least one manifold such as manifolds 220*b*-220*d*. The manifold 220*a* may be configured to provide at least one fluid such as air, nitrogen, inert gas such as helium, neon, argon, krypton, xenon and radon, DI water, acid, base, mist, vapor, other fluid or various combinations thereof. In some embodiments, the manifold 220*b* may be coupled to the pressure valve 215*d* and another pressure valve 225. The pressure valve 215*d* may be coupled to the inter-platen rinse nozzle 135*d*. The pressure valve 225 may be coupled to the inter-platen pressure nozzles 135*a*-135*d*. In some embodiments, the pressure valve 225 may be dissociated from the air switches 210*a*-210*c*. In other embodiments, the pressure valve 225 may not be triggered by clean dry air (CDA) flowing through the air switches 210*a*-210*c*. Though the exemplary embodiment shows three air switches, seven pressure valves and four manifolds which are so configured, the scope of the invention is not limited thereto. Other numbers of the air switches, pressure valves and manifolds may be used in other exemplary embodiments and the air switches, pressure valves and manifolds may be configured differently.

The manifold 220*c* may be coupled to the pressure valves 215*a*-215*c*, which may be coupled to the inter-platen rinse nozzles 135*a*-135*c*, respectively. The manifold 220*d* may be coupled to at least one pressure valve such as pressure valves 230*a*-230*c*, which may be coupled to the dispensers 130*a*-130*c*, respectively.

In some embodiments, the air switches 210*a*-210*c* may receive signals C-1, C-2 and C-3, respectively. The signals C-1 to C-3 may represent the operational status of the CMP apparatus 120 (shown in FIG. 1A). For example, after the polishing steps conducted at the platens 125*a*-125*c* are finished, the processor controlling the operation of the CMP apparatus 120 may generate the signals C-1 to C-3 to turn on the air switches 210*a*-210*c*, respectively. The turn-on of the air switches 210*a*-210*c* may allow clean dry air (CDA) to flow through the air switches 210*a*-210*c*. Though the exemplary embodiment uses the status of the finish of polishing to trigger generation of the signals C-1 to C-3, the scope of the invention is not limited thereto. The operation of the CMP apparatus 120 may represent polishing, idle, shut down, stand-by or other operational status of the CMP apparatus 120.

After flowing through the air switches 210*a*-210*c*, the CDA may flow through and turn on the pressure valves 215*a*-215*d*, such that the manifolds 220*b* and 220*c* may provide a desired amount of mist to the inter-platen rinse nozzles 135*a*-135*d* through the pressure valves 215*a*-215*d*, respectively. In some embodiments, the rinse pressure of the inter-platen rinse nozzles 135*a*-135*d* may be between about 20 psi and about 40 psi, such that mist may have at least about 80% of saturation within the enclosure 110 (shown in FIG. 1A) so as to desirably reduce solidified slurry attached on and/or detached from the inside walls of the enclosure 110.

In some embodiments, a signal I-5 may be transmitted to the pressure valve 225, such that the manifold 220*b* may provide a desired amount of mist to the inter-platen rinse nozzles 135*a*-135*d* so as to clean, for example, the platens 125*a*-125*c* (shown in FIG. 1C). In some embodiments, the signal I-5 may represent an operational state of the CMP apparatus 120 such as polishing, finish of polishing, idle, stand-by, shut-down or other operation of the CMP apparatus 120. In some embodiments, the cleaning step triggered by the signal I-5 may be referred to as "global irrigation."

Referring again to FIG. 2, the signals C-1 to C-3 may be transmitted to pressure valves 230*a*-230*c*, respectively, such that the manifold 220*d* may provide a desired amount of DI water to the dispensers 130*a*-130*c*, respectively, through the pressure valves 230*a*-230*c*. The dispensers 130*a*-130*c* are operative to rinse or clean the platens 125*a*-125*c*, respectively. In some embodiments, the pressure valves 230*a*-230*c* may be disposed in parallel, such that each of the pressure valves 230*a*-230*c* may be independently operated to clean the platens 125*a*-125*c*, respectively. Though the pressure valves 230*a*-230*c* are configured in parallel, the scope of the invention is not limited thereto. Other configurations of the pressure valves may be used in other embodiments.

Figure 3:
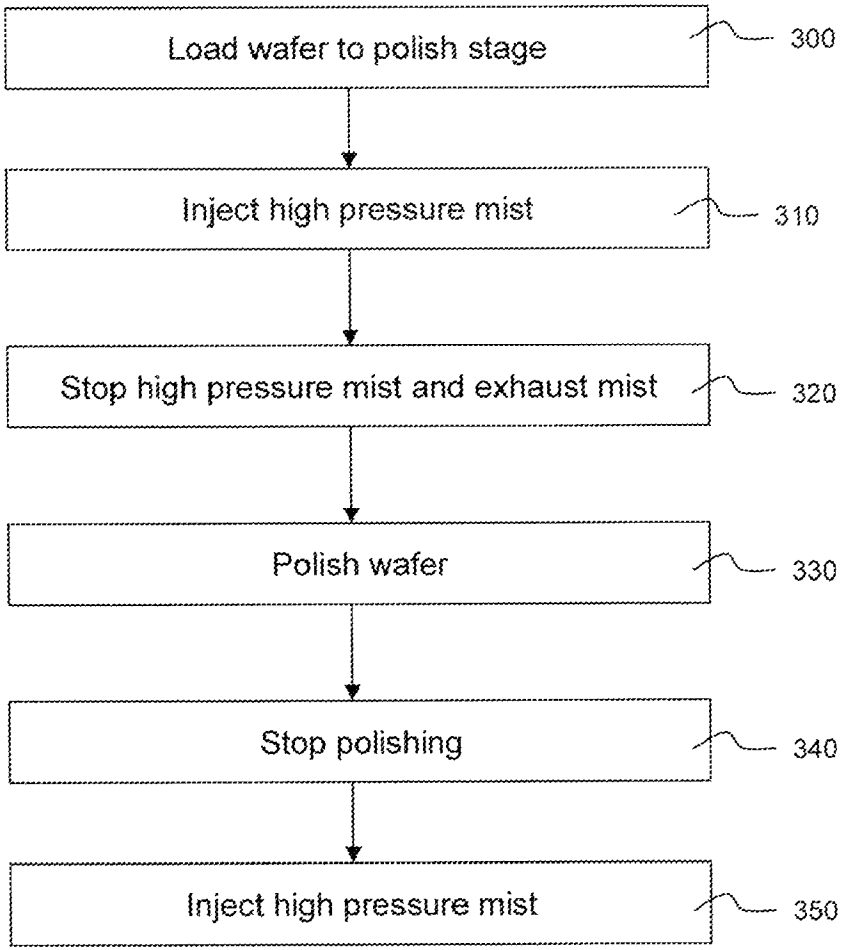
FIG. 3 is a schematic flowchart showing an exemplary CMP process.

FIG. 3 is a schematic flowchart showing an exemplary CMP process. Referring to FIG. 3, step 300 loads a wafer to a polish stage. In some embodiments, step 300 may include using the load cup 145 (shown in FIG. 1B) to load the substrate 150 (shown in FIG. 1B).

Step 310 injects high pressure mist into the enclosure 110 (shown in FIG. 1A). In some embodiments, step 310 may include using at least one of the inter-platen rinse nozzles 135*a*-135*d* to inject mist into the enclosure 110, such that the mist may have at least about 80% of saturation in the enclosure 110. In some embodiments, step 310 may use at least one of the inter-platen rinse nozzles 135*a*-135*d* to inject mist at an injection pressure between about 20 psi and about 40 psi. In some embodiments, step 310 may be omitted or optional, if step 350 described below can desirably remove any solidified slurries that may be present.

Step 320 stops the high pressure mist and/or exhausts mist from the enclosure 110. In some embodiments, step 320 may stop the high pressure mist first and then exhaust mist from the enclosure. In other embodiments, step 320 may stop the high pressure mist while exhausting mist from the enclosure. In still other embodiments, step 320 may be optional, if the mist within the enclosure 110 cannot adversely affect the CMP process.

Step 330 polishes the wafer. In some embodiments, step 330 may load and polish the substrate 150 with a slurry at one of the platens 125*a*-125*c*. During the polishing step 330, the slurry may be spun off and attach to the walls of the enclosure 110, the dispensers 130*a*-130*c*, the load cup 145, the pad conditioners 140*a*-140*c* and/or other parts of the CMP apparatus.

Step 340 then stops polishing the wafer. In some embodiments, step 340 may include stopping polishing the substrate 150 on at least one of the platens 125*a*-125*c* so as to trigger a high pressure mist injection in step 350 (described below). In some embodiments, step 350 may be triggered after the substrate 150 has been subjected to the polishing step at one of the platens 125*a*-125*c*. In other embodiments, step 350 may be triggered after the substrate 150 has been subjected to the polishing steps at two of the platens 125*a*-125*c*. In still other embodiments, step 350 may be triggered after the substrate 150 has been subjected to the polishing steps at the platens 125*a*-125*c*.

Step 350 injects a high pressure mist into the enclosure 110 (shown in FIG. 1A). In some embodiments, step 315 may include using at least one of the inter-platen rinse nozzles 135*a*-135*d* to inject mist into the enclosure 110, such that the mist may have at least about 80% of saturation in the enclosure 110. In some embodiments, the high pressure mist may be present within the enclosure 110 between about 3 seconds and abut 200 seconds.

In some embodiments, step 350 may use at least one of the inter-platen rinse nozzles 135*a*-135*d* to inject mist at an injection pressure between about 20 psi and about 40 psi. By step 350, the spun-off slurry attaching on the walls of the enclosure 110, the dispensers 130*a*-130*c*, the load cup 145, the pad conditioners 140*a*-140*c* and/or other parts of the CMP apparatus may desirably deliquesce and/or be removed away.

Although the present invention has been described in terms of exemplary embodiments, it is not limited thereto. Rather, the appended claims should be construed broadly to include other variants and embodiments of the invention which may be made by those skilled in the field of this art without departing from the scope and range of equivalents of the invention.

What is claimed is:

1. A semiconductor process, comprising:

polishing a substrate with a slurry in an enclosure;

stopping polishing the substrate; and injecting a first mist at a temperature from about 24° C. to about 28° C. into the enclosure, such that the first mist has at least about 80% of saturation of a liquid or gaseous solvent in a carrier within the enclosure.

2. The semiconductor process of claim 1, wherein the step of injecting the first mist has an injection pressure between about 20 psi and about 40 psi.

3. The semiconductor process of claim 1 further comprising:

loading the substrate for polishing; and injecting a second mist into the enclosure, wherein the step of injecting the second mist is between the loading step and the polishing step.

4. The semiconductor process of claim 3, wherein the step of injecting the second mist injects the second mist, such that the second mist has at least about 80% of saturation of liquid or gaseous solvent in a second carrier within the enclosure.

5. The semiconductor process of claim 3, wherein the step of injecting second mist has an injection pressure between about 20 psi and about 40 psi.

6. The semiconductor process of claim 1, wherein the injection step includes mixing a gas and a liquid, the gas has an injection pressure between about 25 psi and about 35 psi, and the liquid has an injection pressure between about 60 psi and about 110 psi.

7. The method of claim 1, wherein the injecting includes supplying air with an injection pressure of 90 to 110 psi.

8. The method of claim 1, wherein the mist is present within the enclosure about 200 seconds.

9. The method of claim 1, further comprising transmitting signals to control a plurality of independently operable pressure valves, to cause a manifold to provide a desired amount of deionized water through the pressure valves to a plurality of dispensers, to rinse or clean a plurality of platens in the enclosure, each platen configured to support a respective substrate for polishing.

10. The method of claim 9, wherein the plurality of signals operate respective air switches that are connected to the pressure valves that control the manifold.

11. A semiconductor process, comprising:

(a) loading a substrate for polishing in an enclosure; and (b) injecting a first mist into the enclosure after step (a) such that the first mist has at least about 80% of saturation of a liquid solvent in a first carrier within the enclosure;

(c) polishing the substrate after step (b) with a slurry in the enclosure;

(d) stopping polishing the substrate;

(e) injecting a second mist at a temperature from about 24° C. to about 28° C. into the enclosure after step (d), such that the second mist has at least about 80% of saturation of a liquid solvent in a second carrier within the enclosure, wherein the steps of injecting the first mist and the second mist have an injection pressure between about 20 psi and about 40 psi.

12. The method of claim 11, wherein:

the injecting includes supplying air with an injection pressure of 90 to 110 psi;

the mist is present within the enclosure about 200 seconds, and the method further comprises transmitting signals to control a plurality of independently operable pressure valves, to cause a manifold to provide a desired amount of deionized water through the pressure valves to a plurality of dispensers, to rinse or clean a plurality of platens in the enclosure, each platen configured to support a respective substrate for polishing, wherein the plurality of signals operate respective air switches that are connected to the pressure valves that control the manifold.

* * * * *